US009752844B1

(12) United States Patent
Huang

(10) Patent No.: US 9,752,844 B1
(45) Date of Patent: Sep. 5, 2017

(54) CROSSBOW STRING COCKING DEVICE

(71) Applicant: Dorge O. Huang, Henry, IL (US)

(72) Inventor: Dorge O. Huang, Henry, IL (US)

( * ) Notice: Subject to any disclaimer, the term of this patent is extended or adjusted under 35 U.S.C. 154(b) by 0 days.

(21) Appl. No.: 15/297,346

(22) Filed: Oct. 19, 2016

(51) Int. Cl.
*F41B 5/12* (2006.01)
*F41B 5/14* (2006.01)

(52) U.S. Cl.
CPC ..... *F41B 5/1469* (2013.01); *F41B 5/12* (2013.01)

(58) Field of Classification Search
CPC ..... F41B 5/12
See application file for complete search history.

(56) References Cited

U.S. PATENT DOCUMENTS 4,593,675 A * 6/1986 Waiser ..... F41B 5/12 124/25
7,100,590 B2 * 9/2006 Chang ..... F41B 5/1469 124/25
8,578,917 B2 * 11/2013 Bednar ..... F41B 5/1469 124/25
8,950,385 B1 * 2/2015 Khoshnood ..... F41B 5/1469 124/1
2002/0059924 A1 * 5/2002 Bednar ..... F41B 5/123 124/25
2010/0170488 A1 * 7/2010 Rasor ..... F41A 11/02 124/25

* cited by examiner

*Primary Examiner* — John Ricci
(74) *Attorney, Agent, or Firm* — Donald J. Ersler

(57) ABSTRACT

A crossbow string cocking device preferably includes a housing, a first reel, a second reel, a ratchet device, a rotary spring, a driven shaft, a drive shaft and a string pull device. The housing preferably includes a main body housing, a first end cover and a second end cover. The ratchet device is retained in a first end of the main body housing. A drive gear is rotatably retained on the drive shaft. The first reel and a ratchet gear of the ratchet device are retained on a first end of the driven shaft. A driven gear, the rotary spring and the second reel are retained on a second end of the driven shaft. The string pull device includes a ribbon and at least one string hook. A first end of the ribbon is retained on the first reel. A second end of the ribbon is retained the second reel.

20 Claims, 7 Drawing Sheets

CROSSBOW STRING COCKING DEVICE

BACKGROUND OF THE INVENTION

1. Field of the Invention

The present invention relates generally to archery and more specifically to a crossbow string cocking device, which does not make a ratcheting noise when the crossbow string is pulled for latching.

2. Discussion of the Prior Art

Many prior art crossbow have one or more of the following disadvantages: a ratcheting noise when drawing a bow string; a large size; a heavy weight; only one ratchet pawl; and a winding string. The ratcheting noise will cause any wild game in an area of the hunter to flee in terror when hearing the bowstring being drawn. It is easier to transport a smaller and lighter bowstring cocking device. A catastrophic failure of a single ratchet pawl, before the bowstring is latched could cause seriously damage to a crossbow and possible injury to the operator. A winding string requires that the string be feed evenly across a width of a reel. Consequently, more structure and more weight must be added to ensure the string is evenly wound on the reel.

Accordingly, there is a clearly felt need in the art for a crossbow string cocking device, which includes a silent operating ratchet device; a reduced size and weight relative to the prior art cocking devices; two ratchet pawls to prevent potential damage to a crossbow; and a winding ribbon with a width of a reel.

SUMMARY OF THE INVENTION

The present invention provides a crossbow string cocking device, which includes two ratchet pawls to prevent potential damage to a crossbow. The crossbow string cocking device preferably includes a housing, a first reel, a second reel, a ratchet device, a rotary spring, a driven shaft, a drive shaft and a string pull device. The housing preferably includes a main body housing, a first end cover and a second end cover. A ratchet cavity is formed in a first end of the main body housing to receive the ratchet device. A driven opening is formed through a bottom of the ratchet cavity. A driven cavity is formed in a second end of the main body housing to provide clearance for a driven gear. A drive bore is formed adjacent the driven cavity to receive the drive shaft. The ratchet device preferably includes a ratchet gear, a ratchet disengagement plate and a pair ratchet pawls. The driven shaft is inserted through the driven opening. The ratchet gear is slid on to the driven shaft in the ratchet cavity and the first reel is slid on to the driven shaft adjacent the ratchet gear. The driven gear is slid on to the driven shaft in the driven cavity. The rotary spring is slid on to the driven shaft, adjacent the driven gear. The second reel is slid on to the driven shaft, adjacent the rotary spring.

A first driven shaft counter bore is formed in the first end cover to receive a first driven bearing. The first driven bearing rotatably supports a first end of the driven shaft. A second driven shaft counter bore is formed in the second end cover to receive a second driven bearing. The second driven bearing rotatably supports a second end of the driven shaft. A first drive shaft counter bore is formed adjacent the driven cavity to receive a first drive bearing. A second drive shaft counter bore is formed in the second end cover, adjacent the second driven shaft counter bore to receive a second drive bearing. A drive gear is retained on the drive shaft. The drive gear drives the driven gear. Each ratchet pawl is pivotally retained on a bottom of the ratchet cavity on opposite sides of the ratchet gear. Each ratchet pawl includes a ratchet finger and a ratchet contact clip. The ratchet disengagement plate is slidably retained in the main body housing. The main body housing includes a block receiver for receiving a mounting block. The block receiver includes a pair of inward facing rails. The mounting block is attached to a cross bow with fasteners or the like. The mounting block includes a pair of rail grooves, fastener holes and a ball cavity. The pair of rail grooves are formed in opposing sides of the mounting block to receive the pair of inward facing rails. The ball cavity is formed in a top of the block. A quick release pin is retained below the block receiver with a detent ball to retain the mounting block in the block receiver. The string pull device includes a ribbon and at least one string hook. A first end of the ribbon is retained on the first reel and a second end of the ribbon is retained on the second reel. The at least one string hook is retained on the ribbon.

Accordingly, it is an object of the present invention to provide a crossbow string cocking device, which includes a silent operating ratchet device.

It is a further object of the present invention to provide a crossbow string cocking device, which includes a reduced size and weight relative to the prior art cocking devices.

It is another object of the present invention to provide a crossbow string cocking device, which includes two ratchet pawls to prevent potential damage to a crossbow if a single ratchet pawl fails.

It is a final object of the present invention to provide a crossbow string cocking device, which includes a winding ribbon with a width of a reel instead of a winding string.

These and additional objects, advantages, features and benefits of the present invention will become apparent from the following specification.

DETAILED DESCRIPTION OF THE PREFERRED EMBODIMENTS

Figure 1:
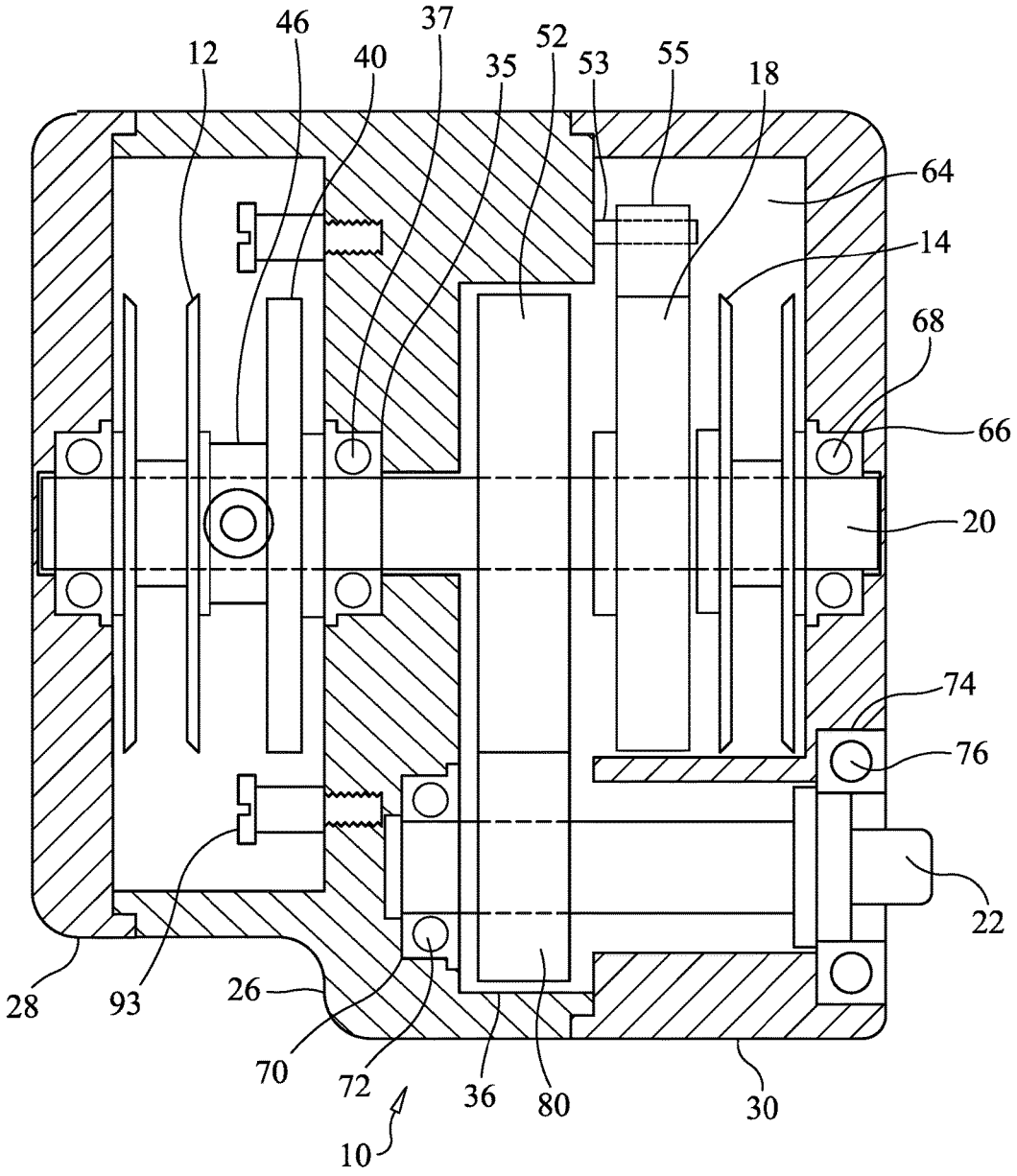
FIG. 1 is a cross sectional view of a crossbow string cocking device in accordance with the present invention.
Figure 4:
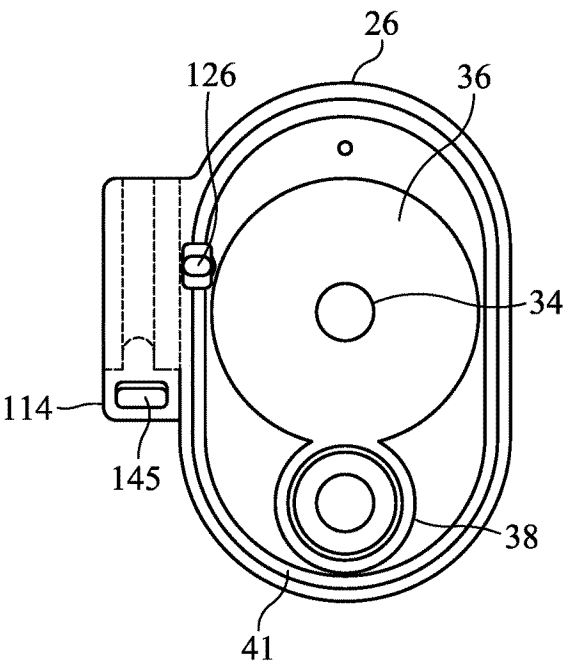
FIG. 4 is a second end view of a main body housing of a crossbow string cocking device in accordance with the present invention.
Figure 3:
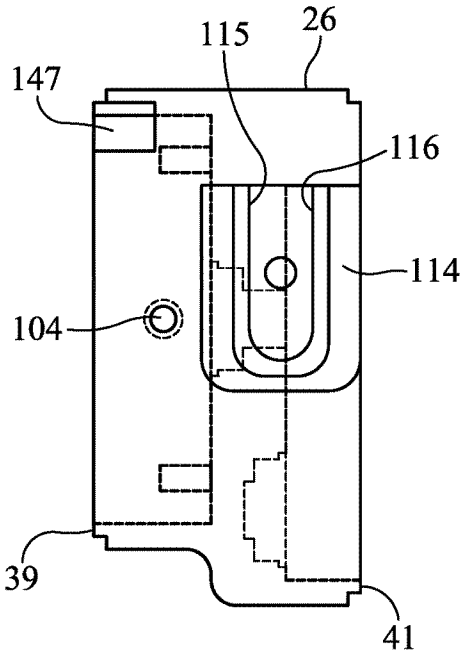
FIG. 3 is a top view of a main body housing of a crossbow string cocking device in accordance with the present invention.
Figure 2:
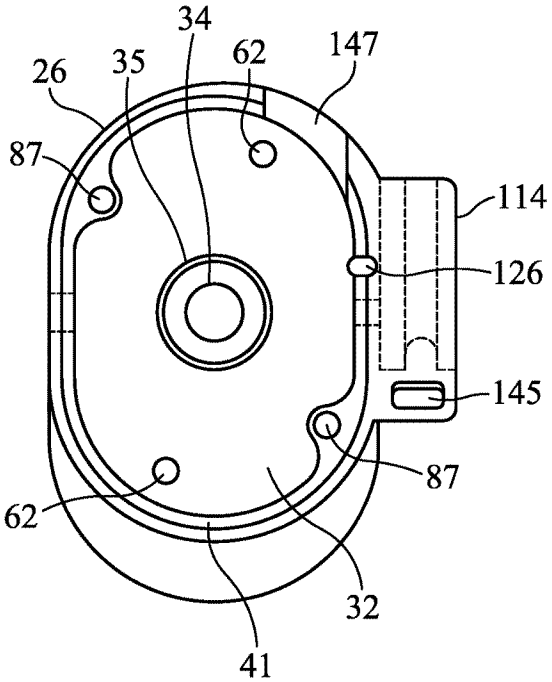
FIG. 2 is a first end view of a main body housing of a crossbow string cocking device in accordance with the present invention.
Figure 11:
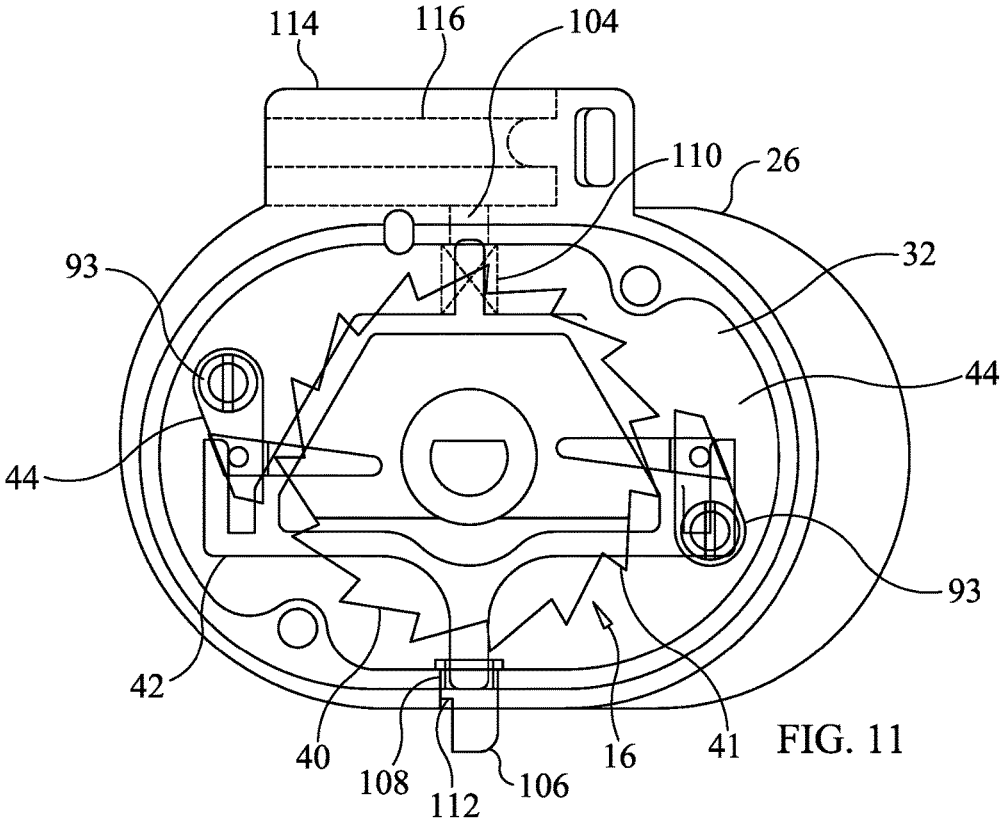
FIG. 11 is a left side view of a main body housing with a ratchet device retained therein of a crossbow string cocking device in accordance with the present invention.
Figure 23:
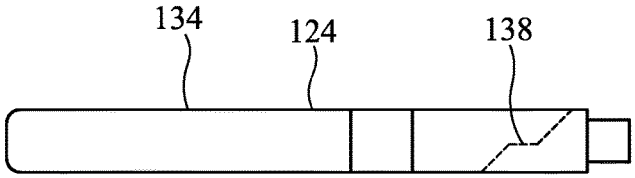
FIG. 23 is a front view of a quick release pin of a crossbow string cocking device in accordance with the present invention.
Figure 24:
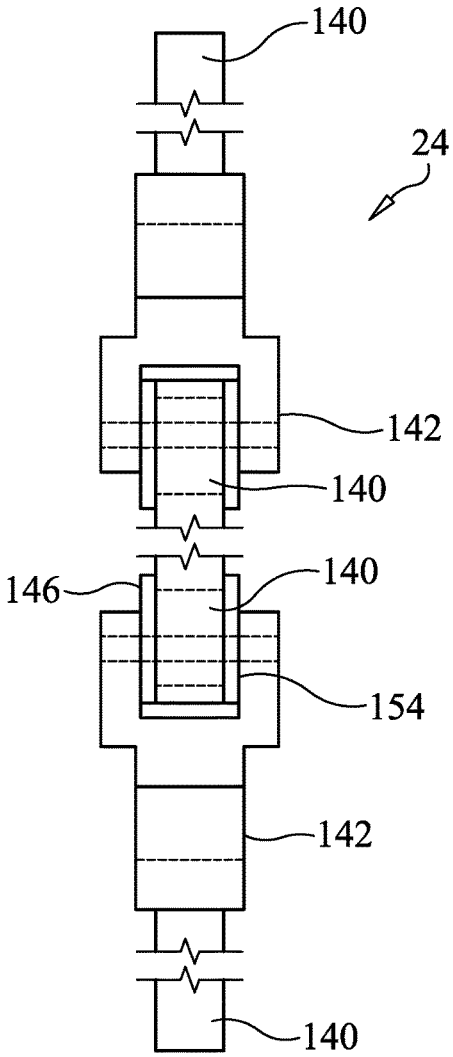
FIG. 24 is a top view of a string pull device of a crossbow string cocking device in accordance with the present invention.

With reference now to the drawings, and particularly to FIG. 1, there is shown a cross sectional view of a crossbow string cocking device 1. With reference to FIGS. 11 and 23-24, the crossbow string cocking device 1 preferably includes a housing 10, a first reel 12, a second reel 14, a ratchet device 16, a rotary spring 18, a driven shaft 20, a drive shaft 22 and a string pull device 24. With reference to FIGS. 2-3, the housing 10 preferably includes a main body housing 26, a first end cover 28 and a second end cover 30. A ratchet cavity 32 is formed in a first end of the main body housing 26 to receive the ratchet device 16. A driven opening 34 is formed through a bottom of the ratchet cavity 32. A middle driven bearing bore 35 is formed in the bottom of the ratchet cavity 32 to receive a middle driven bearing 37. A driven cavity 36 is formed in a second end of the main body housing 26 to receive the driven shaft 20. A drive cavity 38 is formed adjacent the driven cavity 36 to receive the drive shaft 22. A first oval ring 39 is formed on a first end of the main body housing 26 and a second oval ring 41 is formed on a second side of main body housing 26.

Figure 18:
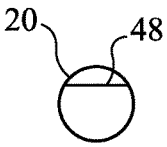
FIG. 18 is an end view of a driven shaft of a crossbow string cocking device in accordance with the present invention.
Figure 19:
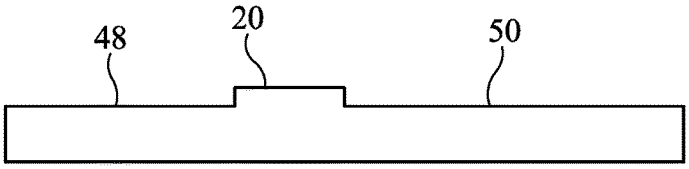
FIG. 19 is a front view of a driven shaft of a crossbow string cocking device in accordance with the present invention.
Figure 20:
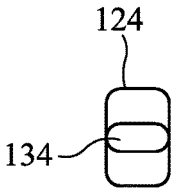
FIG. 20 is a first end view of a quick release pin of a crossbow string cocking device in accordance with the present invention.
Figure 21:
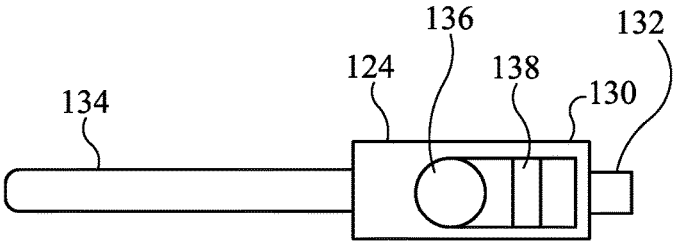
FIG. 21 is a top view of a quick release pin of a crossbow string cocking device in accordance with the present invention.
Figure 22:
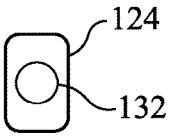
FIG. 22 is a second end view of a quick release pin of a crossbow string cocking device in accordance with the present invention.

With reference to FIGS. 11-14, the ratchet device 16 includes a ratchet gear 40, a ratchet disengagement plate 42 and a pair ratchet pawls 44. The ratchet gear 40 includes a plurality of teeth 41. The driven shaft 20 is inserted through the driven opening 34. The ratchet gear 40 includes a hub 46, which includes a "D" shaped hole. With reference to FIGS. 18-19, the driven shaft 20 includes "D" shaped shaft portions 48, 50 formed on opposing ends of the driven shaft 20. The "D" shaped shaft portions 48, 50 are sized to be received by "D" shaped holes in the ratchet gear 40, the first reel 12, the second reel 14, the rotary spring 18 and a driven gear 52. The first reel 12 is slid on to the driven shaft 20, adjacent the ratchet gear 40. The driven gear 52 is slid on to the driven shaft 20 in the driven cavity 36. The rotary spring 18 is slid on to the driven shaft 20, adjacent the driven gear 52. A free end 55 of the rotary spring 18 is anchored to the main body housing 26 with a retention pin 53 pressed into the main body housing 26. The second reel 14 is slid on to the driven shaft 20, adjacent the rotary spring 18.

Figure 5:
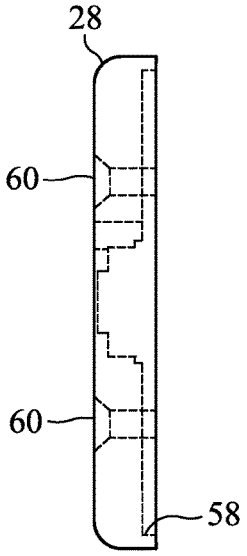
FIG. 5 is a top view of a first end cover of a crossbow string cocking device in accordance with the present invention.
Figure 6:
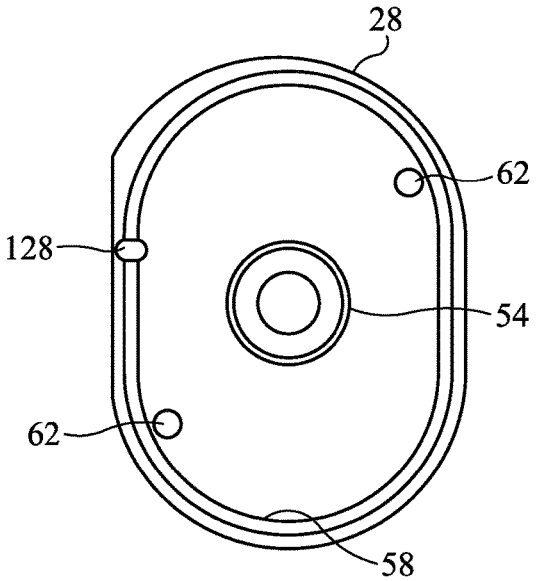
FIG. 6 is an inside side view of a first end cover of a crossbow string cocking device in accordance with the present invention.

With reference to FIGS. 5-6, a first driven shaft counter bore 54 is formed in the first end cover 28 to receive a first driven bearing 56. The first driven bearing 56 rotatably supports a first end of the driven shaft 20. A first oval groove 58 is formed in the first end cover 28 to receive the first oval ring 39 of the main body housing 26. A pair of countersunk fastener holes 60 are formed through the first end cover 28 for attachment of the first end cover 28 to the main body housing 26. A pair of tapped holes 62 are formed at a bottom of the ratchet cavity 32.

Figure 7:
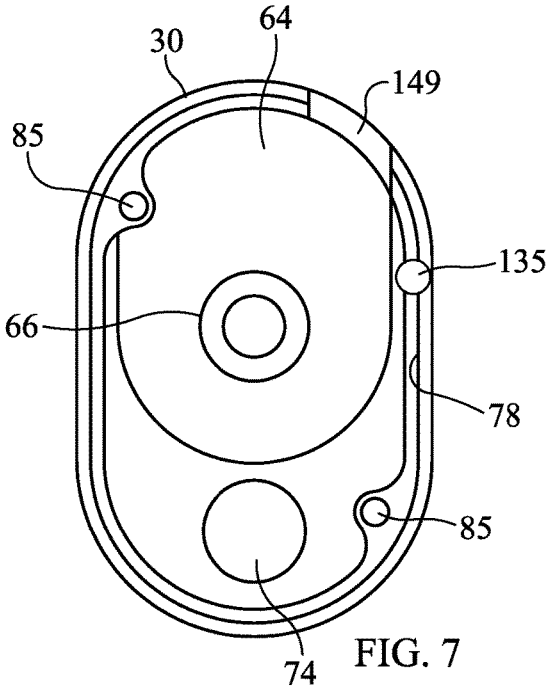
FIG. 7 is an inside side view of a second end cover of a crossbow string cocking device in accordance with the present invention.
Figure 8:
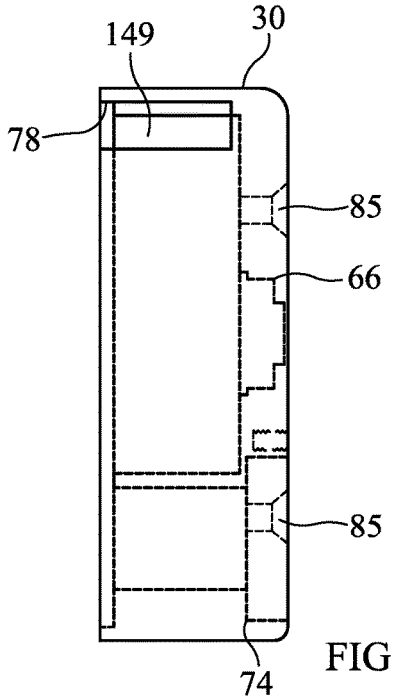
FIG. 8 is a top view of a second end cover of a crossbow string cocking device in accordance with the present invention.
Figure 9:
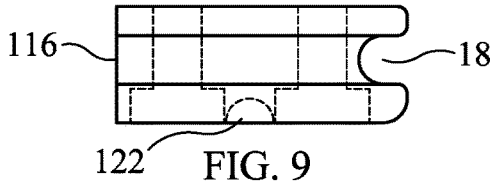
FIG. 9 is a side view of a mounting block of a crossbow string cocking device in accordance with the present invention.
Figure 10:
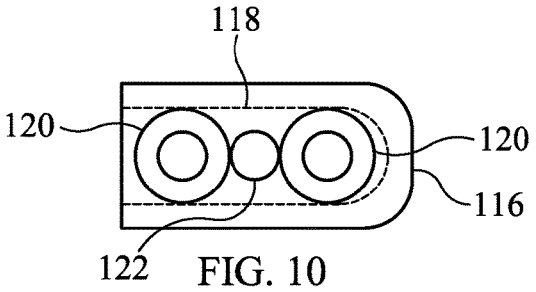
FIG. 10 is a top view of a mounting block of a crossbow string cocking device in accordance with the present invention.

With reference to FIGS. 7-8, a spring cavity 64 is formed in the second end housing 30. A second driven shaft counter bore 66 is formed at a bottom of the spring cavity 64 to receive a second driven bearing 68. The second driven bearing 68 rotatably supports a second end of the driven shaft 20. A first drive bearing counter bore 70 is formed adjacent the driven cavity 36 to receive a first drive bearing 72. A second drive shaft counter bore 74 is formed in the second end cover 30, adjacent the second shaft counter bore 66 to receive a second drive bearing 76. A second oval groove 78 is formed in the second end cover 30 to receive the second oval ring 41 of the main body housing 26. A drive gear 80 includes a "D" shaped hole. The "D" shaped hole of the drive gear 80 is slipped on to a "D" shaped shaft portion 82 formed on one end of the drive shaft 22. A bearing diameter 84 and a bearing shoulder 86 are formed on an opposing end of the drive shaft 22. The bearing diameter 84 is sized to be inserted into the second drive bearing 76. A square projection 85 extends from an end of the bearing diameter 84. The drive gear 80 drives the driven gear 52. A pair of countersunk fastener holes 85 are formed through the second end cover 30. The second end cover 30 is attached to the main body housing 26 with two fasteners (not shown) threaded into a pair of tapped holes 87.

Figure 13:
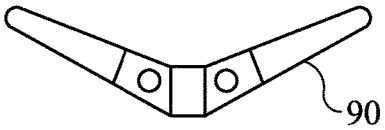
FIG. 13 is a front view of an unbent ratchet contact clip of a ratchet pawl of a crossbow string cocking device in accordance with the present invention.
Figure 14:
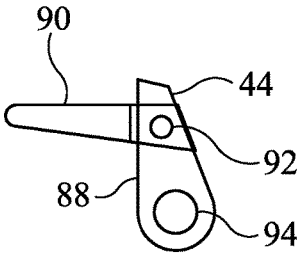
FIG. 14 is a front view of a ratchet pawl of a crossbow string cocking device in accordance with the present invention.
Figure 15:
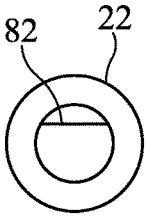
FIG. 15 is a first end view of a drive shaft of a crossbow string cocking device in accordance with the present invention.
Figure 16:
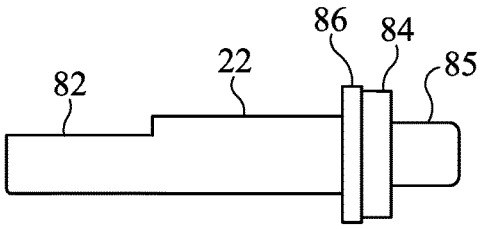
FIG. 16 is a front view of a drive shaft of a crossbow string cocking device in accordance with the present invention.
Figure 17:
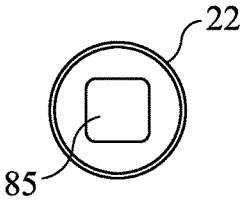
FIG. 17 is a second end view of a drive shaft of a crossbow string cocking device in accordance with the present invention.

With reference to FIGS. 11, 13 and 14, each ratchet pawl 44 includes a ratchet finger 88 and a ratchet contact clip 90. The ratchet contact clip 90 is bent into a U-shape and secured around the ratchet finger 88 with a rivet 92. Each end of the ratchet contact clip 90 contacts opposing sides of the ratchet gear 40. Each ratchet pawl 44 is pivotally retained on a bottom of the ratchet cavity 32 with the shoulder screw 93 inserted through a pivot hole 94. Engagement of the two ratchet pawls 44 with the plurality of teeth 41 does not make a clicking noise.

Figure 12:
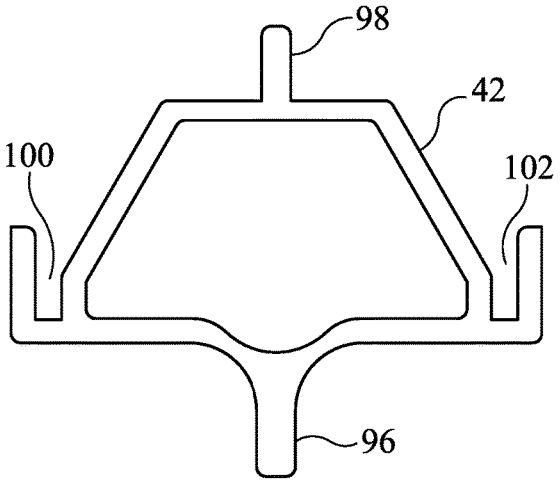
FIG. 12 is a front view of a ratchet disengagement plate of a ratchet device of a crossbow string cocking device in accordance with the present invention.

With reference to FIG. 12, the ratchet disengagement plate 42 preferably includes a bottom projection 96, a top projection 98, a first ratchet slot 100 and a second ratchet slot 102. A top projection hole 104 is formed through a top of the main body housing 26 to receive the top projection 98. The bottom projection 96 is inserted into a disengagement button 106. The disengagement button 106 is retained in a bottom projection opening 108. The disengagement plate 42 is biased to an engagement position with a compression spring 110 retained on the top projection 98. The disengagement button 106 is pushed upward and caught on a disengagement edge 112 to disengage the two ratchet pawls 44 from the ratchet gear 40.

With reference to FIGS. 2-4 and 9-10, the main body housing 26 includes a block receiver 114 for receiving a mounting block 116. The block receiver 114 includes a pair of inward facing rails 115. The mounting block 116 preferably includes a U-shaped peripheral groove 118, which is sized to receive the pair of inward facing rails 115. The mounting block 116 also includes a pair of fastener counter bores 120 and a detent ball cavity 122. The mounting block 116 is attached to a cross bow with a pair of fasteners (not shown). With reference to FIGS. 20-23, a quick release pin 124 is slidably retained in a release hole 126 formed through the main body housing 26 and a release hole 128 formed through the first end cover 28. The quick release pin 124 preferably includes a detent body 130, a spring projection 132 and a push projection 134. The spring projection 132 extends from one end of the detent body 130 and the release projection 134 extends from an opposing end of the detent body 130. A spring pocket 135 is formed in the second end cover 30. A release hole 136 is formed through the detent body 130 to receive a detent ball (not shown). A lock ledge 138 is formed adjacent the release hole 136 to hold the detent ball in the detent ball cavity 122 to prevent the crossbow string cocking device 1 from a crossbow. Pushing the release projection 134 allows the detent ball to disengage from the detent ball cavity 122, such that the crossbow string cocking device 1 may be removed from the crossbow.

Figure 25:
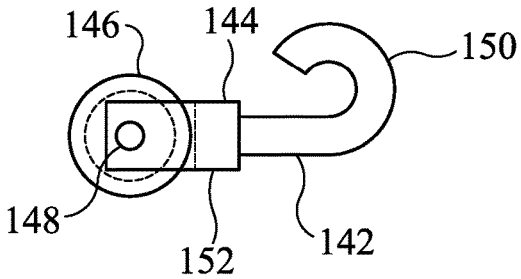
FIG. 25 is a side view of a string hook of a string pull device of a crossbow string cocking device in accordance with the present invention.

With reference to FIGS. 24-25, the string pull device 24 includes a ribbon 140 and at least one string hook 142. A first end of the ribbon 140 is retained on the first reel 12; a second end of the ribbon 140 is inserted through a ribbon slot 145 in the block receiver 114; and a second end of the ribbon 140 is retained on the second reel 14. A first reel slot 147 is formed in the first end of the main body housing 26 to provide clearance for the movement of the ribbon 140 on the first reel 12. A second reel slot 149 is formed in the second end cover 30 to provide clearance for the movement of the ribbon 140 on the second reel 14.

Figure 26:
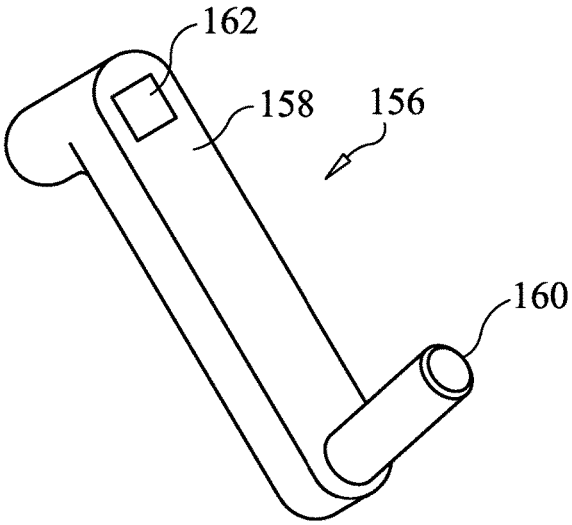
FIG. 26 is a perspective view of a crank arm of a crossbow string cocking device in accordance with the present invention.

The rotary spring 18 biases the ribbon 140 to be reeled on to the first and second reels 12, 14. Each string hook 142 preferably includes a hook body 144, a pulley 146 and a pin 148. The hook body 144 includes a hook end 150 and a slot end 152. A slot 154 is formed in the hook end 152 to receive the pulley 146. The pin 148 is inserted through the slot end 152 and the pulley 146. The pulley 146 rotates relative to the slot end 152. The ribbon 140 is retained in the pulley 146. A bow string (not shown) is retained in the hook end 150. With reference to FIG. 26, a crank arm 156 includes an arm member 158 and a crank pin 160. A square hole 162 is formed through one end of the arm member 158 and the crank pin 160 extends from an opposing end thereof. The square hole 162 is sized to receive the square projection 85. However, other designs of crank arms may also be used.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A crossbow string cocking device comprising:

a drive shaft;

a drive gear is retained on said drive shaft;

a driven shaft;

a driven gear is retained on said driven shaft;

a reel is retained on said driven shaft;

a housing rotatably retains each end of said drive shaft and said driven shaft; and a ratchet device is retained in said housing, said ratchet device includes a ratchet gear and at least one ratchet pawl, said ratchet gear includes a plurality of ratchet teeth, each one of said at least one ratchet pawl includes a ratchet finger and a contact clip, one end of said ratchet finger is pivotally engaged with said housing, an opposing end of said ratchet finger is engaged with said ratchet gear, said contact clip is attached to said ratchet finger, said contact clip contacts opposing sides of said ratchet gear, wherein the engagement of said at least one ratchet pawl does not make a clicking noise.

2. The crossbow string cocking device of claim 1, further comprising:

a rotary spring includes a free end, said rotary spring is retained on said driven shaft, said free end is secured to said housing with a retention pin.

3. The crossbow string cocking device of claim 1, further comprising:

a ratchet disengagement plate includes a bottom projection, a top projection, at least one ratchet slot, said bottom and top projections are axially retained in said housing, said at least one ratchet slot disengages said at least one ratchet pawl from said ratchet gear.

4. The crossbow string cocking device of claim 1 wherein:

said housing includes a main body housing, a first end cover and a second end cover, said first end cover is secured to a first end of said main body housing, said second end cover is secured to a second end of said main body housing.

5. The crossbow string cocking device of claim 1, further comprising:

a string pull device includes at least one hook and a ribbon, said ribbon is retained on said reel, said at least one hook is retained on said ribbon.

6. The crossbow string cocking device of claim 1, further comprising:

a pair of drive bearings rotatably support each end of said drive gear, a pair of driven bearings rotatably support each end of said driven gear.

7. The crossbow string cocking device of claim 1 wherein:

said drive shaft includes a drive projection formed on one end, said drive projection is capable of being inserted into a crank arm.

8. A crossbow string cocking device comprising:

a drive shaft;

a drive gear is retained on said drive shaft;

a driven shaft;

a driven gear is retained on said driven shaft;

a first reel is retained on a first end of said driven shaft;

a second reel is retained on a second end of said driven shaft;

a housing rotatably retains each end of said drive shaft and said driven shaft;

a ratchet device is retained in said housing said ratchet device, said ratchet device prevents rotation of said first and second reels; and a string pull device includes a ribbon and at least one string hook, a first end of said ribbon is retained on said first reel, a second end of said ribbon is retained on said second reel, said at least one string hook is movably retained on said ribbon, said ribbon includes a width which is substantially the same as an inside width of said first and second reels.

9. The crossbow string cocking device of claim 8, further comprising:

a rotary spring includes a free end, said rotary spring is retained on said driven shaft, said free end is secured to said housing with a retention pin.

10. The crossbow string cocking device of claim 8, further comprising:

a ratchet disengagement plate includes a bottom projection and a top projection, said bottom and top projections are axially retained in said housing, wherein axial movement of said ratchet disengagement plate disables said ratchet device.

11. The crossbow string cocking device of claim 8 wherein:

said housing includes a main body housing, a first end cover and a second end cover, said first end cover is secured to a first end of said main body housing, said second end cover is secured to a second end of said main body housing.

12. The crossbow string cocking device of claim 8, further comprising:

a pair of drive bearings rotatably support each end of said drive gear, a pair of driven bearings rotatably support each end of said driven gear.

13. The crossbow string cocking device of claim 8 wherein:

said drive shaft includes a drive projection formed on one end, said drive projection is capable of being inserted into a crank arm.

14. A crossbow string cocking device comprising:

a drive shaft;

a drive gear is retained on said drive shaft;

a driven shaft;

a driven gear is retained on said driven shaft;

a reel is retained on said driven shaft;

a mounting block includes a pair of retention grooves formed in opposing sides thereof, a detent ball cavity is formed in a top of said mounting block, wherein said mounting block is capable of being attached to a crossbow;

a housing rotatably retains each end of said drive shaft and said driven shaft, a block receiver is formed in said housing, said block receiver includes a pair of inward facing rails to slidably receive said pair of retention grooves;

a quick release pin is slidably retained in said housing, said quick release pin includes a detent ball, wherein said detent ball is capable of being retained in said detent ball cavity in a first position, said detent ball is released from said detent ball cavity in a second position; and a ratchet device is retained in said housing said ratchet device, said ratchet device prevents rotation of said reel.

15. The crossbow string cocking device of claim 14, further comprising:

a rotary spring includes a free end, said rotary spring is retained on said driven shaft, said free end is secured to said housing with a retention pin.

16. The crossbow string cocking device of claim 14, further comprising:

a ratchet disengagement plate includes a bottom projection and a top projection, said bottom and top projections are axially retained in said housing, wherein axial movement of said ratchet disengagement plate disables said ratchet device.

17. The crossbow string cocking device of claim 14 wherein:

said housing includes a main body housing, a first end cover and a second end cover, said first end cover is secured to a first end of said main body housing, said second end cover is secured to a second end of said main body housing.

18. The crossbow string cocking device of claim 14, further comprising:

a string pull device includes at least one hook and a ribbon, said ribbon is retained on said reel, said at least one hook is moveably retained on said ribbon.

19. The crossbow string cocking device of claim 14, further comprising:

a pair of drive bearings rotatably support each end of said drive gear, a pair of driven bearings rotatably support each end of said driven gear.

20. The crossbow string cocking device of claim 14 wherein:

said drive shaft includes a drive projection formed on one end, said drive projection is capable of being inserted into a crank arm.

* * * * *